United States Patent [19]

Kimble

[11] 4,387,623

[45] Jun. 14, 1983

[54] PARALLEL MOTION LINKAGE FOR THE SLIDING KEYBOARD COVER OF A PIANO

[75] Inventor: Thomas E. Kimble, Covington, Ky.

[73] Assignee: Baldwin Piano & Organ Company, Cincinnati, Ohio

[21] Appl. No.: 301,384

[22] Filed: Sep. 11, 1981

[51] Int. Cl.[3] ..... G10C 3/02

[52] U.S. Cl. ..... 84/179; 74/103; 248/281.1

[58] Field of Search ..... 84/177–180; 74/96, 103, 519; 248/280.1, 281.1

[56] References Cited

U.S. PATENT DOCUMENTS

| | | | |
|---|---|---|---|
| 491,295 | 2/1893 | Robinson | 74/103 |
| 788,044 | 4/1905 | Haddorff | 84/179 |
| 1,712,980 | 5/1929 | Caroccio | 84/178 |

FOREIGN PATENT DOCUMENTS

| | | | |
|---|---|---|---|
| 499164 | 1/1939 | United Kingdom | 84/177 |

*Primary Examiner*—Lawrence R. Franklin
*Attorney, Agent, or Firm*—Frost & Jacobs

[57] ABSTRACT

A parallel motion linkage is taught for the sliding keyboard cover of a piano to assure that the sliding keyboard cover, when shifted between its open (key exposing) position and its closed (key covering) position will remain perpendicular to the direction of its motion and will not skew or jam between the sides of the piano case. The structure comprises a pair of bell cranks rotatively mounted to the underside of the sliding keyboard cover near the ends thereof. The bell cranks each have a first short arm, which arms are joined together by a tie rod pivotally connected thereto. The bell cranks each have a long arm to which one end of a connecting rod is pivotally mounted. The free end of each connecting rod is detachably and adjustably affixed to a bracket mounted on its respective side of the piano case.

8 Claims, 10 Drawing Figures

PARALLEL MOTION LINKAGE FOR THE SLIDING KEYBOARD COVER OF A PIANO

TECHNICAL FIELD

The invention relates to a parallel motion linkage for the sliding keyboard cover of a piano, and more particularly to such a linkage comprising a pair of bell cranks joined together by a tie rod and adjustably connected to brackets at the piano sides by connecting rods.

BACKGROUND ART

The parallel motion device of the present invention is applicable to many situations and structures wherein it is desired to maintain an elongated shiftable member substantially perpendicular to the direction in which it is being shifted. The parallel motion linkage is particularly adapted for use with the sliding keyboard cover of a piano, and for purposes of an exemplary showing will be described in this application.

It has been common practice to provide the sliding keyboard cover of a piano with some form of parallel motion device to assure that the cover will slide straight and will not skew or jam between the sides of the piano case. Numerous parallel motion mechanisms have been employed such as a scissors type device and a cable and pulley device. Since the 1930s, the most usual type of parallel motion device has comprised a torque rod terminating in cranks at each end to transfer motion from one end of the sliding key cover to the other.

The torque rod mechanism works very well when properly built and installed. Nevertheless, it is characterized by certain deficiencies. First of all, it is difficult to accurately locate and attach the crank terminating linkages in the piano case. As a result, pianos equipped with this mechanism can exhibit a variety of malfunctions. The mounting screws for the linkage are often located in nearly inaccessible places, making removal of the cover for piano tuning or servicing in the field very difficult. Removing the sliding keyboard cover often scratches the piano case. The torque rod mechanism offers little or no adjustment. Furthermore, it must be manufactured in some three to five lengths to accommodate the basic types and sizes of pianos.

The parallel motion linkage of the present invention is easily installed. The sliding keyboard cover may be readily and quickly removed and replaced for piano servicing and tuning in the field. The parallel motion linkage taught herein constitutes a simpler and more efficient mechanism than the prior art structures and affords complete and easy adjustment of the forward stopping position and the parallel condition of the sliding keyboard cover. Furthermore, the mechanism is quiet in operation, and with a single change in tie rod length is applicable to substantially any size and model of piano.

DISCLOSURE OF THE INVENTION

According to the invention there is provided a parallel motion linkage for the sliding keyboard cover of a piano. The linkage serves to assure that the sliding keyboard cover, when shifted between its open (key exposing) position and its closed (key covering) position, will remain perpendicular to the direction of its motion and will not skew or jam between the sides of the piano case.

The parallel motion linkage comprises a pair of crank pivots affixed to the underside of the sliding keyboard cover near its ends. To each crank pivot there is rotatively mounted a bell crank having a first short arm and a second long arm. The short arms of the bell crank are connected to each other by a tie rod. The long arms of the bell crank each have one end of a connecting rod pivotally mounted thereto. The free end of each connecting rod is detachably and adjustably affixed to a bracket mounted on its respective side of the piano case. Each of the brackets can be affixed directly to its respective side of the piano case, or it can be affixed to the slide for the sliding keyboard cover mounted on its respective side of the piano case.

By providing a tie rod of appropriate length, the parallel motion linkage of the present invention can be applied to a full range of piano types and sizes. The mechanism is positive, efficient and substantially silent in its operation.

DETAILED DESCRIPTION OF THE INVENTION

Figure 1:
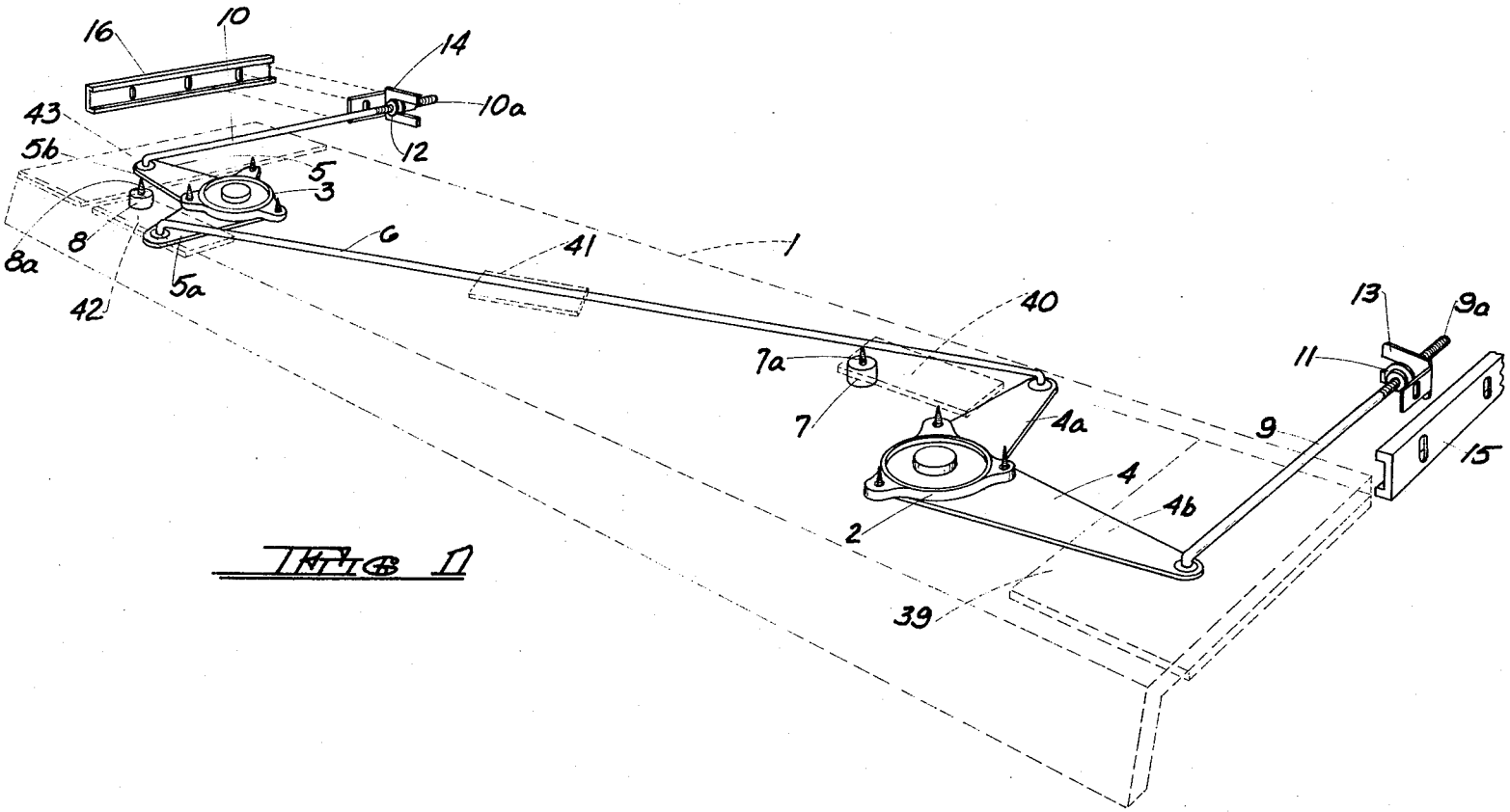
FIG. 1 is a fragmentary, partially exploded, perspective view of the parallel motion linkage of the present invention, with a conventional sliding keyboard cover indicated in broken lines.

Turning first to FIG. 1, a conventional sliding keyboard cover is shown in broken lines at 1. The parallel motion linkage of the present invention is illustrated, mounted to the underside of the sliding keyboard cover 1. Basically, the invention comprises a pair of bell crank pivots 2 and 3 mounted to the underside of the sliding keyboard cover 1. Bell crank pivot 2 rotatively mounts a bell crank 4 and a bell crank 5 is rotatively mounted on bell crank pivot 3. The bell cranks 4 and 5 are identical. Bell crank 4 has a short arm **4*a* and a long arm 4*b* and bell crank 5 has a short arm 5*a* and a long arm 5*b*. The short bell crank arms 4*a* and 5*a* are joined together by a tie rod 6. A pair of resilient stops 7 and 8 are shown mounted to the underside of sliding keyboard cover 1 by means of screws 7*a* and 8*a*. The stops 7 and 8 are adapted to cooperate with bell crank short arms 4*a* and 5*a***, as will be described hereinafter.

A connecting rod 9 is pivotally attached at one of its ends to the end of the long arm **4*b* of bell crank 4. An identical connecting rod 10 is pivotally attached at one of its ends to the long arm 5b of bell crank 5. The free ends 9a and 10a of connecting rods 9 and 10 are threaded as shown. Adjustment knobs 11 and 12 are threadedly engaged on the connecting rod ends 9a and 10a, respectively. In turn, the adjustment knobs 11 and 12 are releasably engaged in brackets 13 and 14, respectively. Brackets 13 and 14 can be mounted at appropriate positions directly to the inside surfaces of the piano case sides (not shown). Alternatively, the brackets may be mounted on the slides (not shown) upon which the sliding keyboard cover shifts as it is caused to move between its closed (key covering) position and its open (key exposing) position. Finally, the brackets 13 and 14 may be adjustably mounted on additional mounting brackets shown in FIG. 1 at 15 and 16. The mounting brackets 15 and 16** are themselves affixed at appropriate positions to the inside surfaces of the piano case sides.

Figure 2:
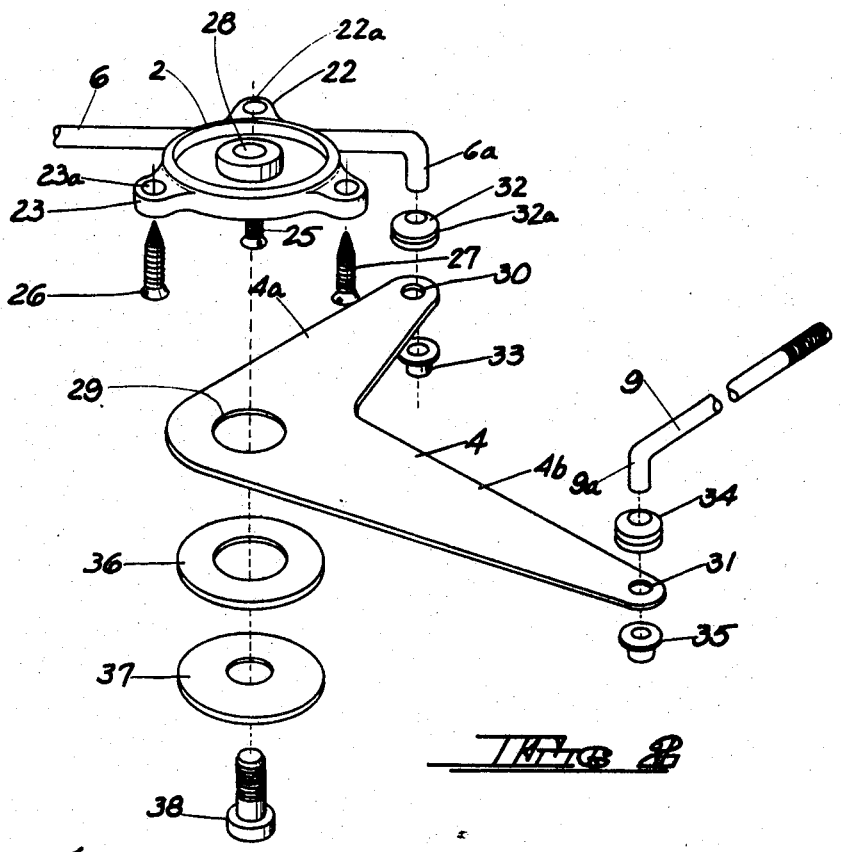
FIG. 2 is a fragmentary, perspective, exploded view of the right bell crank and its associated parts, as viewed in FIG. 1.

Reference is now made to FIGS. 2 through 5, wherein like parts have been given like index numerals. FIG. 2 is an exploded view illustrating the assembly of bell crank pivot 2, bell crank 4, tie rod 6 and connecting rod 9.

Figure 3:
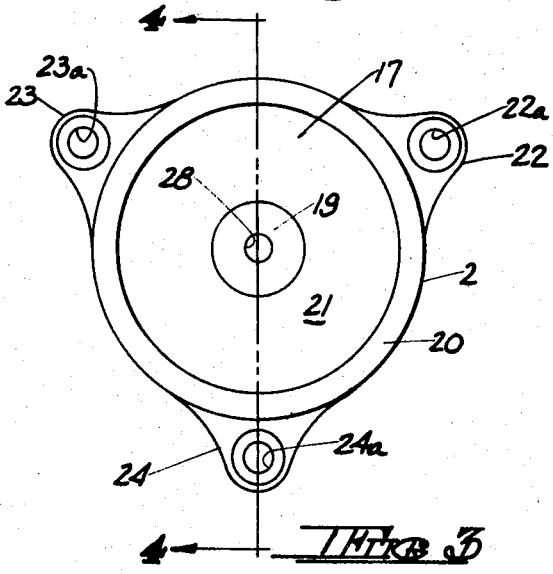
FIG. 3 is a bottom plan view of the bell crank pivot of FIG. 2.
Figure 4:
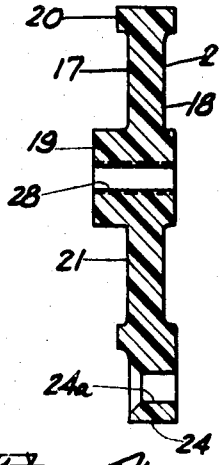
FIG. 4 is a cross sectional view taken along section line 4—4 of FIG. 3.

Bell crank pivot 2 is best shown in FIGS. 3 and 4. The bell crank pivot comprises a disk-like element having a bottom side 17 and a top side 18. The bell crank pivot comprises a central cylindrical hub 19, an outer annular rim 20 and a connecting annular web 21. Evenly spaced about and extending radially from rim 20, there are three ears 22, 23 and 24. The ears 22 through 24 are provided with perforations 22a through 24a which are countersunk and adapted to receive flat head screws 25 through 27 (see FIG. 2) by which the bell crank pivots are affixed to the underside of sliding keyboard cover 1. It will be noted from FIG. 4 that on the upper side 18 of the bell crank pivot, the hub 19, the rim 20, and the ears (one of which is shown at 24) are coplanar so as to abut the inside surface of sliding keyboard cover 1. The hub 19 has a threaded axial bore 28, the purpose of which will be evident hereinafter. The bell crank pivot 3 is identical to bell crank pivot 2. The bell crank pivots may be made of any appropriate material and lend themselves well to being molded of plastic material.

Figure 5:
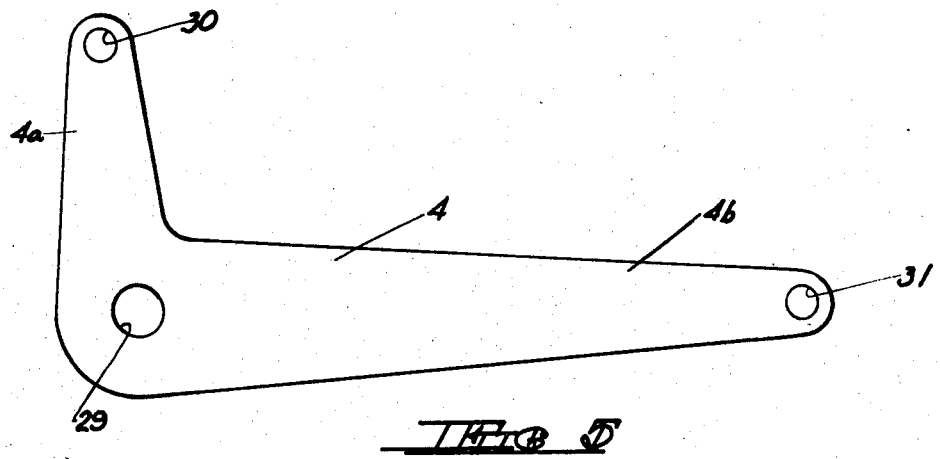
FIG. 5 is a plan view of the bell crank of FIG. 2.

Bell crank 4 is clearly shown in FIGS. 2 and 5. The bell crank, at the juncture of arms 4a and 4b is provided with a perforation 29. The perforation 29 is of a diameter such that it will just nicely receive the hub 19 of bell crank pivot 2 and be rotatable thereon. The bell crank 4, when mounted on hub 19, will be supported by rim 20.

The short arm 4a of bell crank 4 has a perforation 30 therein. The perforation 30 is intended to receive one end of tie rod 6, as will be described hereinafter. In similar fashion, the long arm 4b has a perforation 31 at its free end, intended to receive an end of connecting rod 9. Bell cranks 4 and 5 are identical and can be made of any appropriate material, preferably metal.

Reference is now made to FIGS. 1 and 2. The perforation 30 at the end of the short arm 4a of bell crank 4 is provided with a resilient washer or bearing 32. The washer has an outside diameter greater than the diameter of perforation 30 and is provided with a circumferential notch 32a. By this means, the resilient washer 32 can be mounted in the bell crank arm perforation 30. The end of tie rod 6 to be pivotally affixed to the bell crank arm 4a is bent downwardly, as shown at 6a. The tie rod portion 6a is inserted in resilient washer 32 and is maintained in position by cap or push nut 33. The resilient washer or bearing 32, which may be made of plastic, rubber or the like, serves as a silent bearing for the end 6a of tie rod 6, not only permitting the tie rod to pivot freely with respect to the bell crank arm 4a, but also enabling some play in the movement of the tie rod.

Connecting rod 9 is attached to the free end of the bell crank long arm 4b in an identical manner. Thus, the end 9a of connecting rod 9 is bent downwardly and the perforation 31 in the bell crank long arm 4b is provided with a resilient washer or bearing 34, identical to washer or bearing 32. The end 9a of the connecting rod is inserted in the washer or bearing 34 and is held in place by a cap or push nut 35.

The bell crank pivot 2 is affixed to the underside of the sliding keyboard cover 1 by means of screws 25 through 27. Thereafter, the bell crank 4 is mounted on the bell crank pivot 2 with the bell crank pivot hub 19 extending through bell crank perforation 29. The bell crank 4 is followed by a fabric or felt washer 36, sized to fit over hub 19. Thereafter, a metal washer 37 is mounted on the end of the hub and the entire assembly is joined together by bolt 38 which is threadedly engaged in the axial bore 28 of the bell crank pivot 2. It will be understood by one skilled in the art that the mounting of bell crank 5 and the connection of tie rod 6 to its short arm 5a and connecting rod 10 to its long arm 5b is accomplished in precisely the same manner. To insure against noise through contact of the inside surface of the sliding keyboard cover 1 by the parallel motion linkage, pads of felt or other appropriate material may be strategically located on the inside surface of the sliding keyboard cover. Such pads are indicated in FIG. 1 at 39 through 43 (see also FIGS. 9 and 10).

Figure 6:
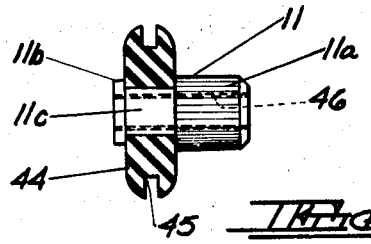
FIG. 6 is a side elevational view, partially in cross section, of an adjusting knob of the present invention.

Adjustment knob 11 is illustrated in FIG. 6. The knob 11 has a rearward portion 11a, the surface of which may be knurled or otherwise configured to easy grasping. The adjustment nut also has a forward portion 11b of approximately the same exterior diameter as the rearward portion 11a. Between the portions 11a and 11b, a third portion 11c is provided with a lesser diameter. The portion 11c is configured to accept a resilient washer or bushing 44 having an annular peripheral notch 45 therein. The washer or bushing 44 may be made of rubber, plastic or other appropriate resilient material. To complete the adjustment knob, it is provided with an axial threaded bore 46. In this fashion, the adjustment knob is threadedly engaged on the threaded end 9a of connecting rod 9. It will be understood that the adjustment knob 12 is in everyway identical to adjustment knob 11. While the adjustment knob 11 may be made of metal or the like, it may also be made of plastic.

Figure 7:
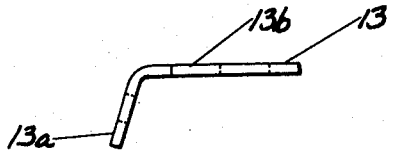
FIG. 7 is a plan view of a bracket of the present invention.
Figure 8:
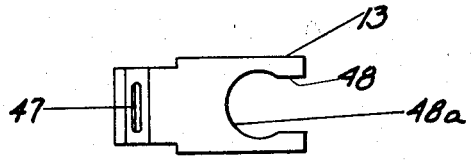
FIG. 8 is a front elevational view of the bracket of FIG. 7.

Bracket 13 (see FIG. 1) is illustrated in FIGS. 7 and 8. The bracket 13 comprises an L-shaped metallic member having a first leg 13a and a second leg 13b. The legs 13a and 13b are angularly related. The leg 13a is provided with an elongated perforation 47 by which it may be adjustably screwed directly to the inside surface of the piano case side, directly to the adjacent keyboard cover slide or to mounting bracket 15, illustrated in FIG. 1. The longer leg 13b has a notch 48 formed therein and terminating in a circular portion 48a. The notch 48 is of a width slightly less than the diameter of peripheral notch 45 in resilient washer or bushing 44 of adjustment knob 11. The circular notch 48a is of a diameter substantially the same as that of the resilient washer or bushing notch 45. As a result, the notch portion 45 of washer or bushing 44 can be forced through notch 48 into notch portion 48a of bracket 13 with a "snap-fit". It will be understood that bracket 14 is identical to bracket 13 and adjustment knob 12 will have a removable "snap-fit" engagement therewith.

The parts of the parallel motion linkage of the present invention having been described in detail, the installation and use thereof will now be described. To install the parallel motion linkage of the present invention, the bell crank pivots 2 and 3 are affixed to the underside of the sliding keyboard cover 1 and the bell cranks 4 and 5, with tie rod 6 and connecting rods 9 and 10 affixed thereto, are mounted on the bell crank pivots. Mounting brackets 15 and 16 having been appropriately affixed to the inside surfaces of the piano case sides, brackets 13 and 14 are mounted thereon, respectively. At this stage, the sliding keyboard cover is ready for installation on the piano. To this end, the sliding keyboard cover is located in its proper closed (key covering) position on the piano. The connecting rods 9 and 10 are then pulled rearwardly of the sliding keyboard cover until bell cranks 4 and 5 stop rotating. In other words, the bell cranks are rotated until the short arm 4*a* of bell crank 4 contacts stop 7 (see FIG. 1) and the short arm 5*a* of bell crank 5 contacts stop 8. The adjustment knobs 11 and 12 are thereafter turned into alignment with their respective brackets 13 and 14 and are then snapped into their respective brackets. At this point, the parallel motion linkage and the sliding keyboard cover are fully mounted and ready for use. Any additional initial or corrective adjustments of the forward stopping position of the sliding keyboard cover 1 and its parallel condition can be made simply by turning adjustment knobs 11 and 12 in the appropriate directions.

Figure 9:
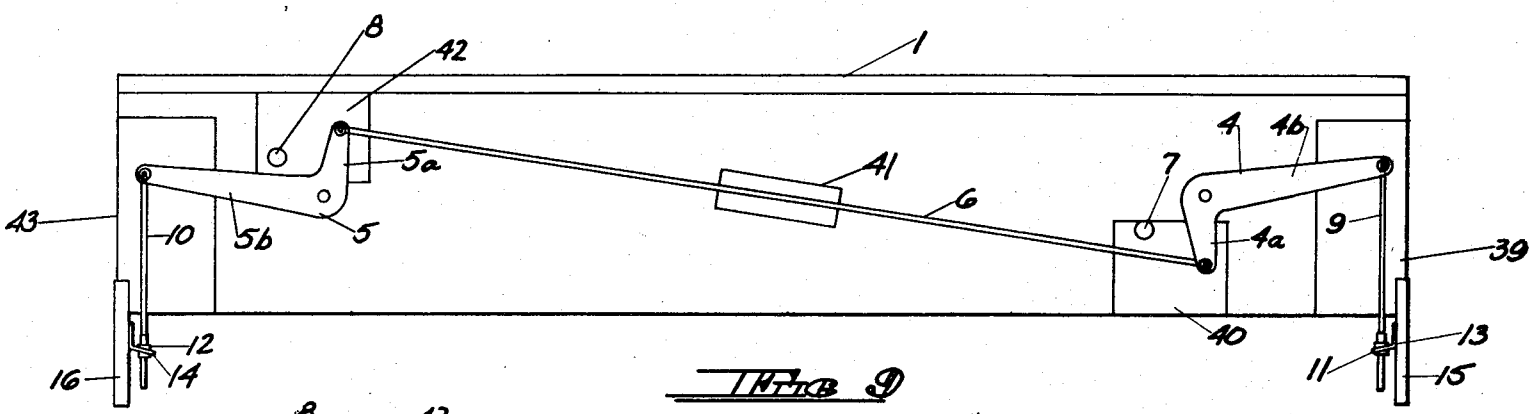
FIGS. 9 and 10 are simplified bottom plan views of an exemplary sliding keyboard cover with the parallel motion linkage of the present invention mounted thereon, and showing the relative positions of the linkage parts when the sliding keyboard cover is in its open (key exposing) position and its closed (key covering) position, respectively.
Figure 10:
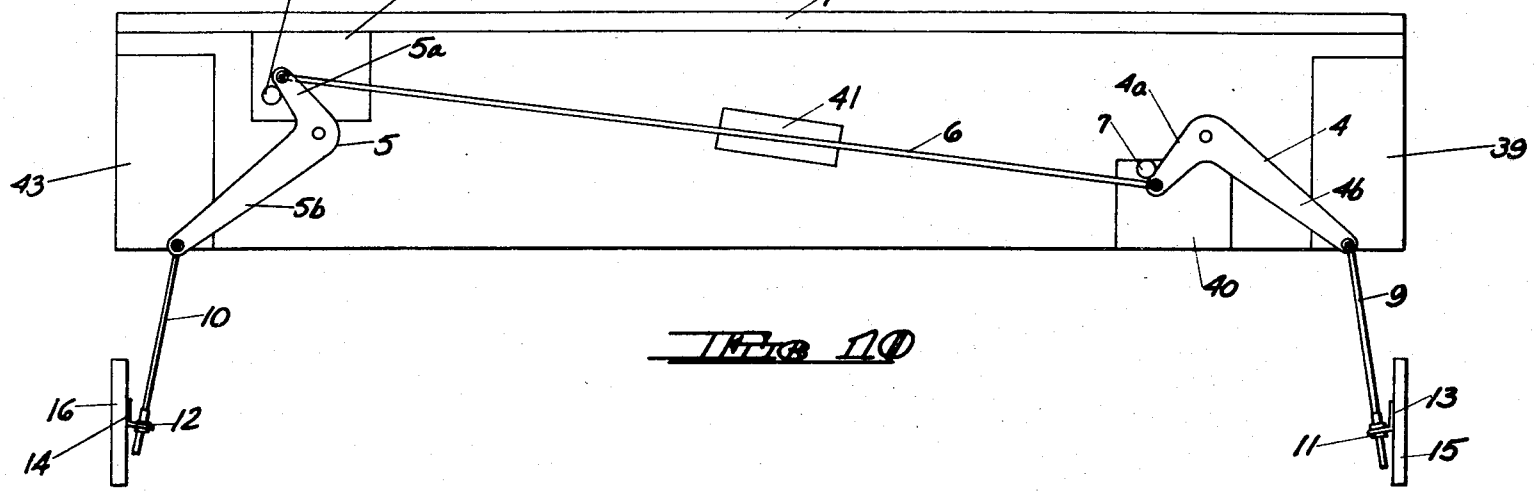

FIGS. 9 and 10 are simplified bottom views of the sliding keyboard cover 1 with the parallel motion linkage mounted thereon. In FIG. 9, the sliding keyboard cover 1 is illustrated in its open (key exposing) position. This position will be determined by abutment of the sliding keyboard cover against appropriate stops within the piano case (not shown). FIG. 10 illustrates the structure of FIG. 9 with the sliding keyboard cover in its closed (key covering) position. As will be evident from FIG. 10, this position of the sliding keyboard cover 1 will be determined by the effective length of the connecting rods 9 and 10 after adjustment of adjustment knobs 11 and 12 and abutment of the short arm 4*a* of bell crank 4 against stop 7 and the short arm 5*a* of bell crank 5 against stop 8.

In shifting the sliding keyboard cover 1 from its closed (key covering) position to its open (key exposing) position, the sliding keyboard cover in most instances must be lifted slightly so that its forwardmost portion clears the keys. Upon return to its closed (key covering) position, the sliding keyboard cover will drop downwardly over the forward ends of the keys. The resilient washers or bearings 32 and 34 through which tie rod 6 and connecting rod 9 are pivotally connected to bell crank 4, and the similar washers or bearing used in association with bell crank 5, together with the resilient washers in association with adjustment knobs 11 and 12 permit sufficient vertical and horizontal movement of the various parts of the parallel motion linkage to accommodate for vertical shifting of the sliding keyboard cover. It will be further noted in FIG. 10, that when the sliding keyboard cover 1 is in its fully closed position, the ends of connecting rod 9 and 10, which are pivotally attached to bell cranks 4 and 5, have shifted slightly toward each other, as compared to their substantially parallel condition when the sliding keyboard cover 1 is in its open position, as shown in FIG. 9. Again, this is permitted by virtue of the resilient nature of the washer 44 mounted on adjustment knob 11 and similar washer mounnted on adjustment knob 12. It will be apparent from FIGS. 9 and 10 that as the sliding keyboard cover 1 is shifted between its open (key exposing) position and its closed (key covering) position, the parallel motion linkage will prevent skewing or jamming of the sliding keyboard cover. If, during piano servicing or tuning in the field, it is necessary to remove sliding keyboard cover 1 from the piano, it is only necessary to release adjustment knobs 11 and 12 from their respective brackets 13 and 14, once released, the sliding keyboard cover 1 can be removed from the piano quickly and easily and without danger of scratching the piano case.

Modifications may be made in the invention without departing from the spirit of it.

What is claimed is:

1. In a piano of the type having a piano case, a keyboard and an elongated sliding keyboard cover extending transversely of said piano case and being shiftable between an open (key exposing position) and a closed (key covering) position, the improvement comprising a parallel motion linkage assembly to assure that said sliding keyboard cover shifts in a direction perpendicular to its long axis to prevent skewing or jamming of said cover in said case, said parallel motion linkage comprising a pair of identical, oppositely oriented bell cranks rotatively affixed to the underside of said sliding keyboard cover near the ends thereof, said bell cranks each having a short arm and a long arm oriented at about 90° to each other, a tie rod, said short arms of said bell cranks being connected together by said tie rod pivotally affixed to the ends thereof, a pair of connecting rods having first and second ends, said first end of each of said connecting rods being pivotally affixed to the end of said long arm of one of said bell cranks, and means to adjustably secure each of said connecting rods near said second end thereof to said piano case.

2. The structure claimed in claim 1 including stop means mounted on the underside of said sliding keyboard cover and so positioned as to be abutted by said bell crank short arms when said cover is in said closed position to assist in determining said closed position.

3. The structure claimed in claim 1 wherein said means to adjustably secure said connecting rods to said piano case comprise bracket means affixed to said piano case for each of said connecting rods, said second ends of said connecting rods being threaded, an adjustment knob threadedly engaged on each connecting rod and axially shiftable thereon, each of said adjustment knobs being rotatably and releasably engaged in one of said brackets.

4. The structure claimed in claim 3 including a resilient washer mounted on each of said adjustment knobs, said resilient washers each having an annular peripheral groove, each of said brackets having a notch formed therein and so configured as to receive said peripherally grooved portion of said resilient washer of its respective adjustment knob with a releasable snap-fit.

5. The structure claimed in claim 3 including stop means mounted on the underside of said sliding keyboard cover and so positioned as to be abutted by said bell crank short arms when said cover is in said closed position to assist in determining said closed position.

6. The structure claimed in claim 5 including a resilient washer mounted on each of said adjustment knobs, said resilient washers each having an annular peripheral groove, each of said brackets having a notch formed therein and so configured as to receive said peripherally grooved portion of said resilient washer of its respective adjustment knob with a releasable snap-fit.

7. A parallel motion linkage assembly for use with a a member shiftable between two positions to maintain that axis of said member transverse the direction of shifting substantially perpendicular to said direction of shifting, said parallel motion linkage assembly comprising a pair of identical, oppositely oriented bell cranks spaced from each other and rotatively affixed to said member along an imaginary line perpendicular to said direction of motion, said bell cranks each having a short arm and a long arm oriented at about 90° to each other, a tie rod, said short arms of said bell cranks being connected together by said tie rod pivotally affixed to the ends thereof, a pair of connecting rods having first and second ends, said first end of each of said connecting rods being pivotally affixed to the end of said long arm of one of said bell cranks, each of said connecting rods extending from its respective bell crank long arm in substantially the same direction and generally in the direction of said shifting, and means to anchor said second ends of said connecting rods against axial movement.

8. The structure claimed in claim 7 wherein said connecting rods are adjustable with respect to said anchoring means to vary the effective length of that portion of said connecting rods extending between their respective bell crank long arms and anchoring means.

* * * * *